US010876802B2

(12) United States Patent
Dolderer et al.

(10) Patent No.: US 10,876,802 B2
(45) Date of Patent: Dec. 29, 2020

(54) STACKED PLATE HEAT EXCHANGER

(71) Applicant: Mahle International GmbH, Stuttgart (DE)

(72) Inventors: Axel Dolderer, Grossbottwar (DE); Andreas Draenkow, Heimsheim (DE); Timo Feldkeller, Asperg (DE); Thomas Mager, Schoenaich (DE); Thomas Merten, Knittlingen (DE); Markus Wesner, Stuttgart (DE)

(73) Assignee: Mahle International GmbH

( * ) Notice: Subject to any disclaimer, the term of this patent is extended or adjusted under 35 U.S.C. 154(b) by 62 days.

(21) Appl. No.: 16/396,152

(22) Filed: Apr. 26, 2019

(65) Prior Publication Data

US 2019/0331436 A1 Oct. 31, 2019

(30) Foreign Application Priority Data

Apr. 27, 2018 (DE) ..... 10 2018 206 574

(51) Int. Cl.

| | |
|---|---|
| ***F28F 3/14*** | (2006.01) |
| ***F28F 3/12*** | (2006.01) |
| ***F28F 3/04*** | (2006.01) |
| ***F28D 9/00*** | (2006.01) |

(52) U.S. Cl.

CPC ..... *F28F 3/12* (2013.01); *F28D 9/005* (2013.01); *F28F 3/048* (2013.01)

(58) Field of Classification Search

CPC ..... F28F 3/12; F28F 3/048; F28D 9/005
USPC ..... 165/170
See application file for complete search history.

(56) References Cited

U.S. PATENT DOCUMENTS

| | | | |
|---|---|---|---|
| 7,533,717 B2 | 5/2009 | Hummel et al. | |
| 9,134,073 B2 * | 9/2015 | Malugani | F28D 9/0037 |
| 9,557,116 B2 | 1/2017 | Velte | |

(Continued)

FOREIGN PATENT DOCUMENTS

| | | |
|---|---|---|
| DE | 10347181 A1 | 5/2005 |
| DE | 102010028660 A1 | 11/2011 |

(Continued)

OTHER PUBLICATIONS

German Search reportd dated Feb. 21, 2019 for copending German Application No. DE 10 2018 206 574.8.
English Translation of DE 102012202276.

*Primary Examiner* — Davis D Hwu
(74) *Attorney, Agent, or Firm* — Fishman Stewart PLLC

(57) ABSTRACT

A stacked plate heat exchanger may include a plurality of stacked plates stacked on top of one another, between which a plurality of hollow spaces for two media may be alternately defined. The plurality of stacked plates may include at least two first stacked plates and at least one second stacked plate. The plurality of stacked plates may respectively include at least one first passage opening surrounded by a dome and at least one second passage opening. The at least one second passage opening of the at least one second stacked plate may be surrounded by an annular bead. The at least one second stacked plate may be arranged between the at least two first stacked plates such that the dome of a lower first stacked plate, the dome of an upper first stacked plate, and the annular bead are connected to one another and define an immersion tube.

20 Claims, 5 Drawing Sheets

(56) References Cited

U.S. PATENT DOCUMENTS

| | | | | |
|---|---|---|---|---|
| 2003/0106679 | A1* | 6/2003 | Brost | F28D 9/005 165/154 |
| 2013/0277026 | A1 | 10/2013 | Geser | |
| 2014/0013787 | A1* | 1/2014 | Wesner | H01M 10/60 62/239 |

FOREIGN PATENT DOCUMENTS

| | | | |
|---|---|---|---|
| DE | 102012202276 | A1 | 8/2013 |
| DE | 102012202361 | A1 | 8/2013 |

* cited by examiner

STACKED PLATE HEAT EXCHANGER

CROSS-REFERENCE TO RELATED APPLICATION

This application claims priority to German Application No. DE 10 2018 206 574.8, filed on Apr. 27, 2018, the contents of which are hereby incorporated by reference in its entirety.

TECHNICAL FIELD

The invention relates to a stacked plate heat exchanger comprising multiple stacked plates that are stacked on top of one another and soldered to one another, between which hollow spaces for two media are alternately formed.

BACKGROUND

Stacked plate heat exchangers are already known from the prior art and are employed for example as oil cooler, iCond or chillers in a motor vehicle. A stacked plate heat exchanger comprises multiple longitudinal stacked plates that are stacked on top of one another, between which hollow spaces are formed. Two media—a cooling medium and a medium to be cooled—flow in the hollow spaces arranged on top of one another, so that a heat exchange can take place between the two media. Here, the hollow spaces are delimited by a surface and a surface edging of the respective stacked plate and by the stacked plate that is adjacently supported. In each of the stacked plates, four openings are usually provided which in the stacked plates lying on top of one another correspond to one another and altogether form four passages that are perpendicular relative to the stacked plates. Two of these passages are provided for the inflow and outflow of the one medium and two of these passages are provided for the inflow and outflow of the other medium in the respective hollow spaces. The hollow spaces for the two media alternate in the stacked plate heat exchanger and the passages are exclusively fluidically connected to the corresponding hollow spaces.

In order to be able to realise certain fluid flow paths with stacked plate heat exchangers, an immersion tube is needed which internally conducts the fluid through the stacked plate block. A further reason for an immersion tube is the realisation of connection situations desired by the customer. Such immersion tubes however are extra components which cause additional costs and reduce the process reliability because of possible leakages on sealing points and connections between immersion tube and further components, such as for example a cover plate or a base plate.

The present invention therefore deals with the problem of stating an improved or at least an alternative embodiment for a stacked plate heat exchanger of the generic type, which overcomes the disadvantageous known from the prior art.

SUMMARY

According to the invention, this problem is solved through the subject of the independent claim(s). Advantageous embodiments are subject of the dependent claim(s).

The present invention is based on the general idea of no longer forming an immersion tube provided for realising a predefined fluid flow path in a stacked plate block of a stacked plate heat exchanger as a separate component and accepting the accompanying disadvantages such as for example connecting problems or tightness problems, but integrating this immersion tube in the stacked plate of the stacked plate heat exchanger so that the same with completely soldered stacked plate heat exchanger block is formed by the individual stacked plates. By way of this, the process unreliabilities known from the prior art and also the additional costs for an extra immersion tube and an assembly of the same can be at least reduced, preferentially even entirely prevented. The stacked plate heat exchanger according to the invention comprises multiple stacked plates that are stacked on top of one another and are soldered to one another between which hollow spaces for two media, for example coolant and oil, are alternately formed. In a first stacked plate, at least one first passage opening and at least one second passage opening are provided, of which the at least one first passage opening is surrounded by a dome protecting from a stacked plate plane. According to the invention, at least one second stacked plate is now provided, which differs from the first stacked plate with regard to its shape and which likewise comprises at least one first passage opening with a projecting dome and a second passage opening, wherein the second passage opening is surrounded by an annular bead projecting from a stacked plate plane. The at least one second stacked plate is arranged between two adjacent first stacked plates in such a manner that a free edge of the annular bead is tightly connected to a free edge of the dome of a first stacked plate arranged below the same and an annular bead peak region is tightly connected to a foot of the dome of a first stacked plate arranged above the same. Through the alternating combination of the first and second stacked plates, an immersion tube passage and thus an immersion tube can thus be formed via the annular beads and domes respectively. Thus, the immersion tube constitutes an integral part of the stacked plate heat exchanger and the not, as in the past, be initially prefabricated as a separate component and subsequently installed in the stacked plate heat exchanger. Through the integral forming of the immersion tube via the individual stacked plate of the stacked plate heat exchanger it is not only possible to reduce the assembly expenditure but above all significantly increase a process reliability since leakage problems during the soldering of the immersion tube to the individual stacked plates or a base plate that occurred up to now no longer apply at all.

In an advantageous further development of the solution according to the invention, the at least one second passage opening is punched into the first stacked plate. By way of this, such a second passage opening cannot only be produced in a process-reliable manner but also extremely accurately and cost-effectively. The stacked plates proper usually have a circumferential, raised edge via which they are connected, in particular soldered tightly to a stacked plate arranged below the same or above the same.

In an advantageous further development of the solution according to the invention, at least two first openings that are spaced from one another in the circumferential direction are provided in the first stacked plate radially outside of the dome of the first stacked plate. Together with a second stacked plate, in the case of which the annular bead peak region is flattened and comprises second openings, a return passage can be formed with the first and second openings, which annular surrounds the immersion tube passage. Here, the first openings and the second openings with the soldered stacked plate heat exchanger are arranged aligned with one another. By way of the annular beads or domes of the first and second stacked plates respectively, and the first and second openings aligned with one another, an immersion tube passage located inside and a return passage substantially surrounding the same annularly can thus be coaxially arranged in the same place, which offers design advantages that were not possible in the past.

In an advantageous further development of the solution according to the invention, the first openings and/or the second openings are formed in the shape of a circle or in the shape of an annular segment. In particular a design in the form of an annular segment can be produced by means of a simple punching tool, wherein by way of a respective circumferential extension of the openings in the form of an annular segment a cross section through which a flow can flow can be adjusted. The more first and second openings arranged aligned with the former are provided, the greater is a flow cross section of the return passage.

In a further advantageous embodiment of the solution according to the invention, a turbulence insert is arranged in at least one hollow space. By means of such a turbulence insert, a turbulent flow can be achieved in the respective hollow space and thus a heat transfer significantly improved. Such turbulence inserts can be formed as separate components which are arranged in the respective hollow space but also as positive or negative curvatures in a respective stacked plate bottom, wherein the latter offers the major advantage that by way of this an integral forming of the turbulence inserts in the stacked plate is made possible, as a result of which the parts variety and connected with this the storage and logistics costs can be reduced as can be an assembly expenditure.

Practically, the stacked plate heat exchanger is designed as a chiller, as an oil cooler or as an indirect evaporator. By way of this non-conclusive enumeration it is possible to imagine the manifold possible applications on offer for the stacked plate heat exchanger according to the invention.

Further important features and advantages of the invention are obtained from the subclaims, from the drawings and from the associated figure description by way of the drawings.

It is to be understood that the features mentioned above and still to be explained in the following cannot only be used in the respective combination stated but also in other combinations or by themselves without leaving the scope of the present invention.

Preferred exemplary embodiments of the invention are shown in the drawings and are explained in more detail in the following description, wherein same reference characters relate to same or similar or functionally same components.

BRIEF DESCRIPTION OF THE DRAWINGS

It shows, in each case schematically

DETAILED DESCRIPTION

Figure 1:
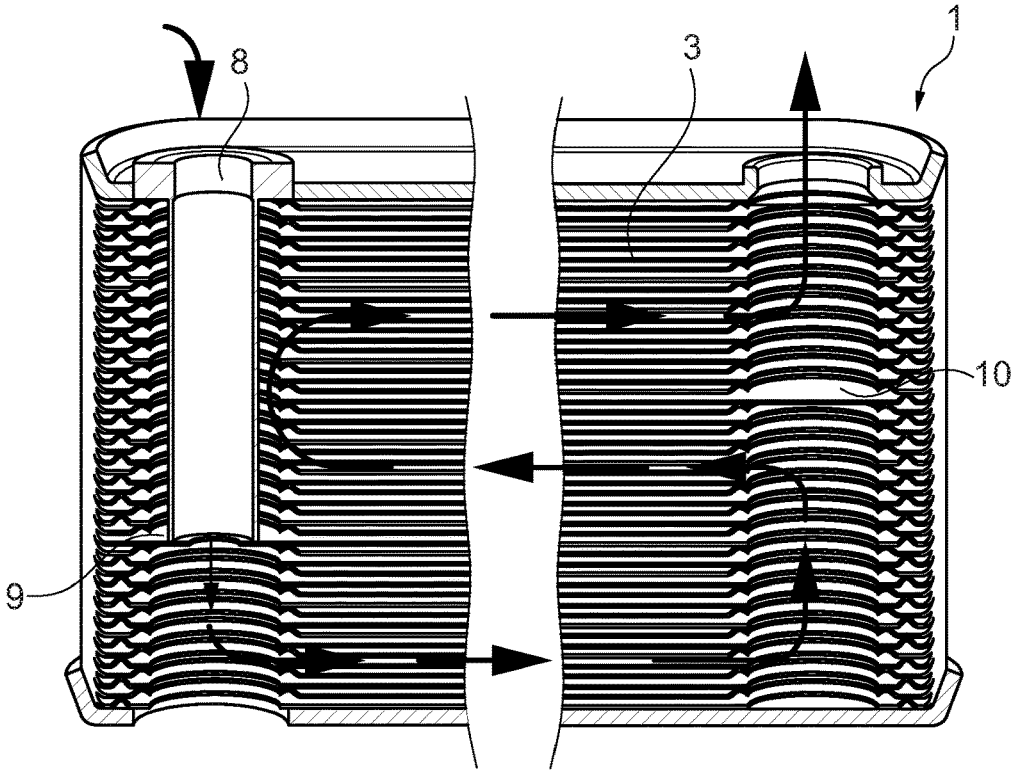
FIG. 1 shows a sectional representation through a stacked plate heat exchanger according to the prior art with a separate immersion tube.

According to FIG. 1, a stacked plate heat exchanger 1 comprises multiple stacked plates 2 that are stacked on top of one another and soldered to one another, here first stacked plates 4, between which hollow spaces 3 for different media are alternately formed. In the first stacked plate 4 at least one first passage opening 5 and at least one second passage opening 6 are provided, of which the at least one first passage opening 5 is surrounded by a dome 7 projecting from a stacked plate plane (see also FIGS. 2 to 11). The stacked plate heat exchanger 1 additionally comprises an immersion tube 8 that is formed as a separate component, which has to be tightly assembled in the stacked plate heat exchanger 1 and brings about a predefined flow through the stacked heat exchanger 1. This immersion tube 8 formed as a separate component involves comparatively high costs and also a comparatively high assembly expenditure, so that the stacked plate heat exchangers 1 according to the invention, shown as per the FIGS. 2 to 11, no longer have this separate immersion tube 8 but the immersion tube is integrated in the stacked plates 2 in the case of these. Looking again at FIG. 1 it is evident that the immersion tube 8 with its lower side is tightly connected to a first partition plane 9, wherein in the stacked plate heat exchanger 1 according to FIG. 1 a second partition plane 10 is additionally provided. The two partition planes 9, 10 enforce a meander-like flow through the stacked plate heat exchanger 1.

In the stacked plate heat exchanger 1 according to the invention as per the FIGS. 2 to 11, at least one second stacked plate 11 is now provided, which likewise comprises at least one passage opening 5 with a projecting dome 7 and a second passage opening 6, wherein the second passage opening 6 is surrounded by an annular bead 12 which projects from a stacked plate plane. The at least one second stacked plate 11 is arranged between two adjacent first stacked plates 4 in such a manner that a free edge 13 of the annular bead 12 is tightly connected to a free edge 14 of the dome 7 of a first stacked plate 4 arranged below the same (see also FIGS. 6 and 7). At the same time, an annular bead peak region 15 is tightly connected to a foot 16 of the dome 7 of a first stacked plate 4 arranged above the same, i.e. soldered. Here, a first passage opening 5 of the first stacked plate 4 is always arranged aligned with a second passage opening 6 of a second stacked plate 11. By way of the first and second stacked plates 4, 11 according to the invention, an immersion tube passage 17 can thus be formed through the respective domes 7 and annular beads 12, which forms an integral part of the stacked plate heat exchanger 1 and need not be formed, as in the past, by an immersion tube 8 that needs to be separate produced and installed. By way of this, not only assembly advantages can be achieved but also a higher process reliability in terms of the tightness.

Figure 2:
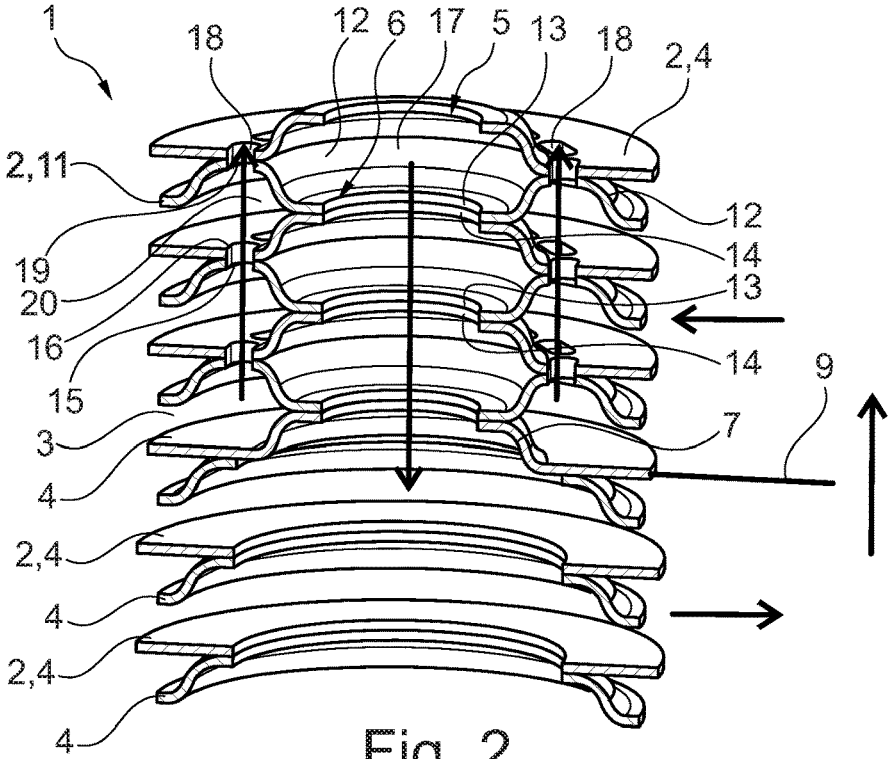
FIG. 2 shows a sectional representation through a stacked plate heat exchanger according to the invention with immersion tube and return passage integrated in the stacked plates.

Viewing FIG. 2 in more detail, it is evident with the stacked plate heat exchanger 1 according to the invention shown there in the section, that the immersion tube passage 17 is exclusively formed by the stacked plates 4 and 11, wherein a length of the immersion tube passage 17 is dependent on the number of the installed second stacked plates 11. In FIG. 2, three second stacked plates 11 are shown which terminate with the lower first stacked plate 4 as first partition plane 9. Below the first partition plane 9, the stacked plate heat exchanger 1 is only formed by first stacked plates 4, which, rotated about a vertical axis, are stacked on top of one another so that in each case a first passage opening 5 of a first stacked plate 4 is aligned with a second passage opening 6 of a first stacked plate 4 arranged on top of the same and also soldered to one another in this region.

Figure 3:
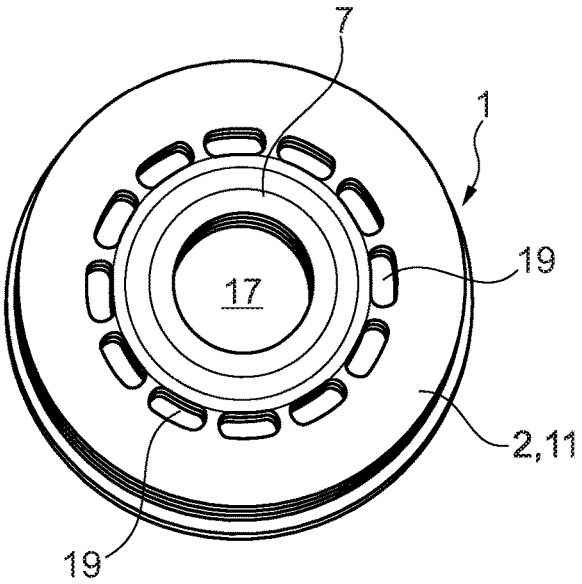
FIG. 3 shows a representation as in FIG. 2, however from above.
Figure 4:
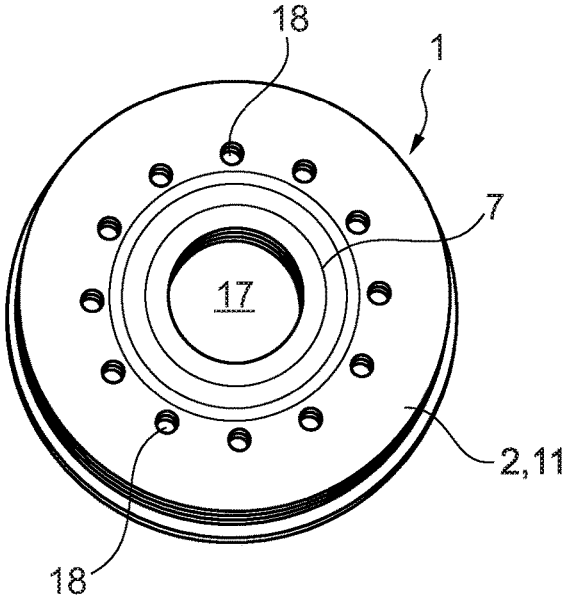
FIG. 4 shows a representation as in FIG. 3, however with circular openings.
Figure 5:
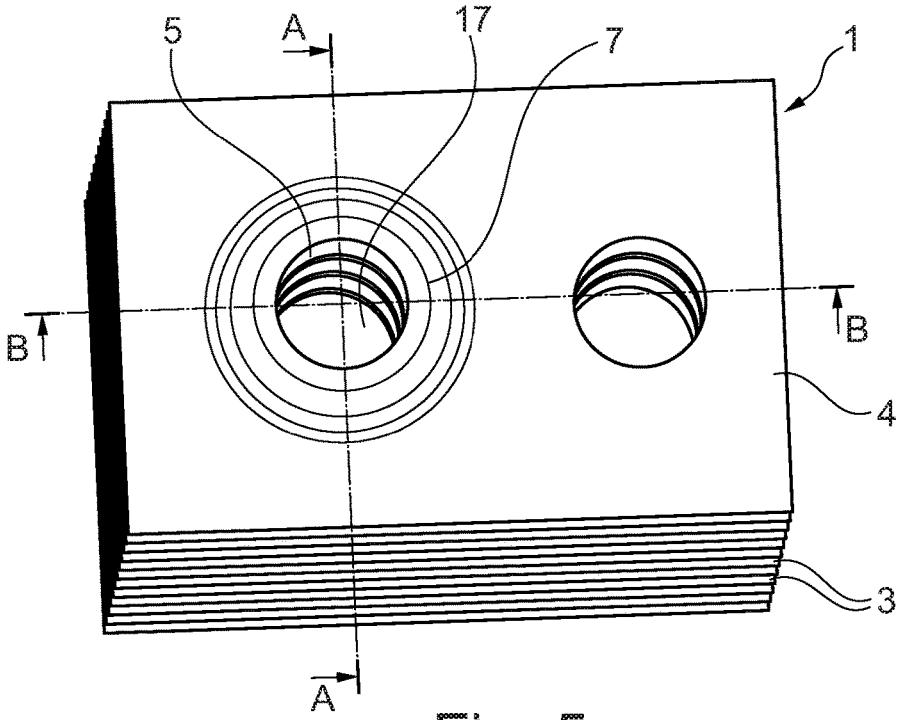
FIG. 5 shows a plan view of a stacked plate heat exchanger according to the invention.

Viewing the FIGS. 2 to 4 further, it is evident that radially outside the dome 7 at least two first openings 18 that are spaced from one another in the circumferential direction are provided in the first stacked plate 4. These can for example be likewise produced by punching and thus extremely accurately and cost-effectively. Viewing FIG. 2 further, it is evident that the annular bead peak region 15 of the second stacked plate 11 is flattened and comprises two openings 19. The first openings 18 and/or the second openings 19 can be in the form of a circle (see FIG. 4) or in the form of an annular segment, as is shown for example according to FIG. 3. With the stacked plate heat exchanger 1 soldered, the first and second openings 18, 19 are arranged aligned with one another and form a return passage 20 which annularly surrounds the immersion tube passage 17. Here, "annularly" is to mean uninterrupted annularly. In the embodiment shown according to FIG. 2, the immersion tube passage 17 and the return passage 18 can thus be integrally formed in the stacked plates 4, 11.

In addition to this, turbulence inserts 21 (see FIG. 7) can be arranged between the individual stacked plates 2, 4, 11, which enforce a turbulent flow and thus an improved heat transfer/heat exchange. Generally, the stacked plate heat exchanger 1 can be designed as a chiller, oil cooler or as an indirect evaporator.

Figure 6:
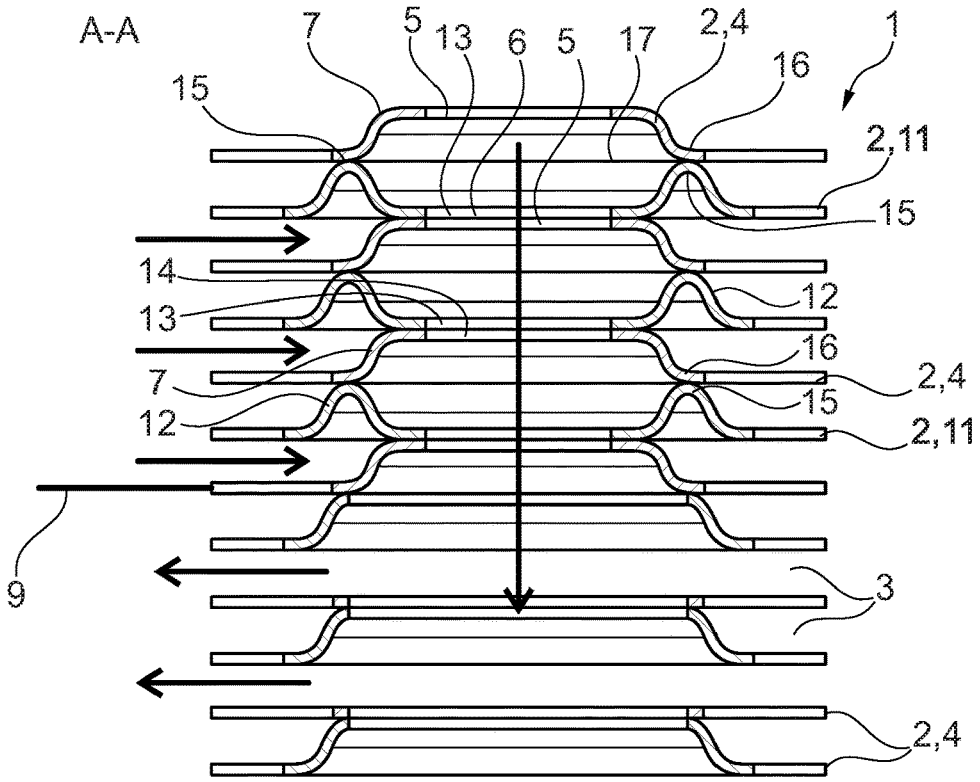
FIG. 6 shows a sectional representation along the section plane A-A from FIG. 5.
Figure 7:
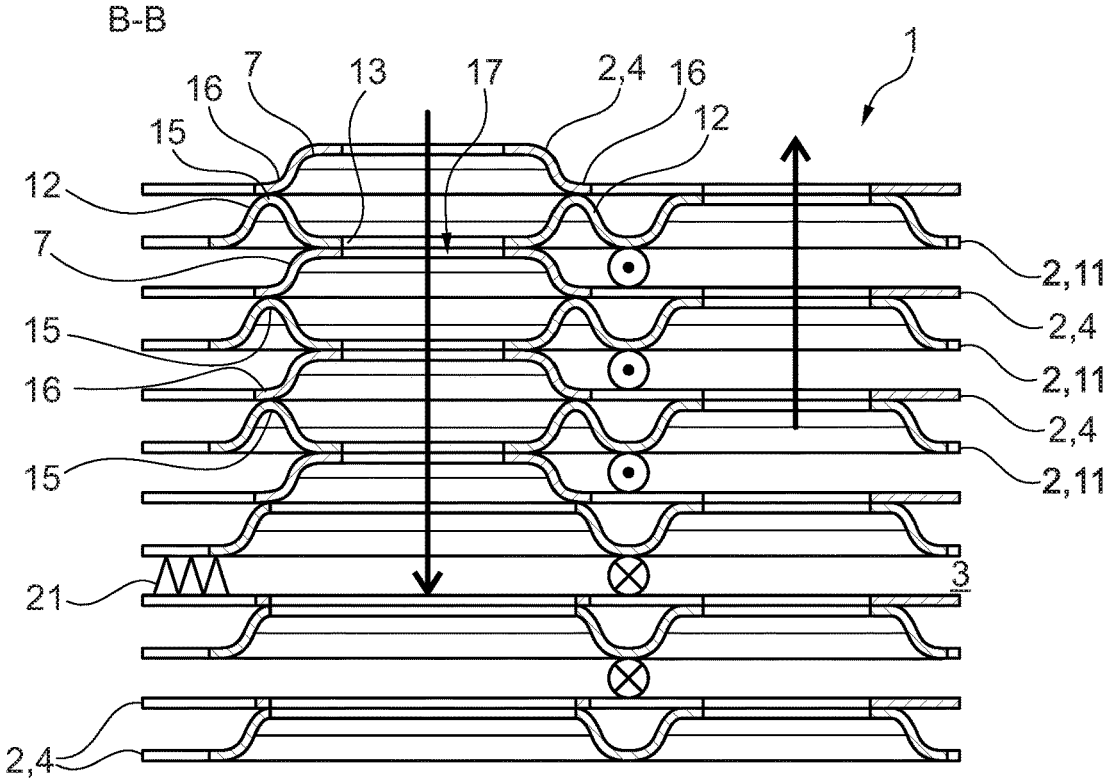
FIG. 7 shows a sectional representation along the section plane B-B from FIG. 5.
Figure 8:
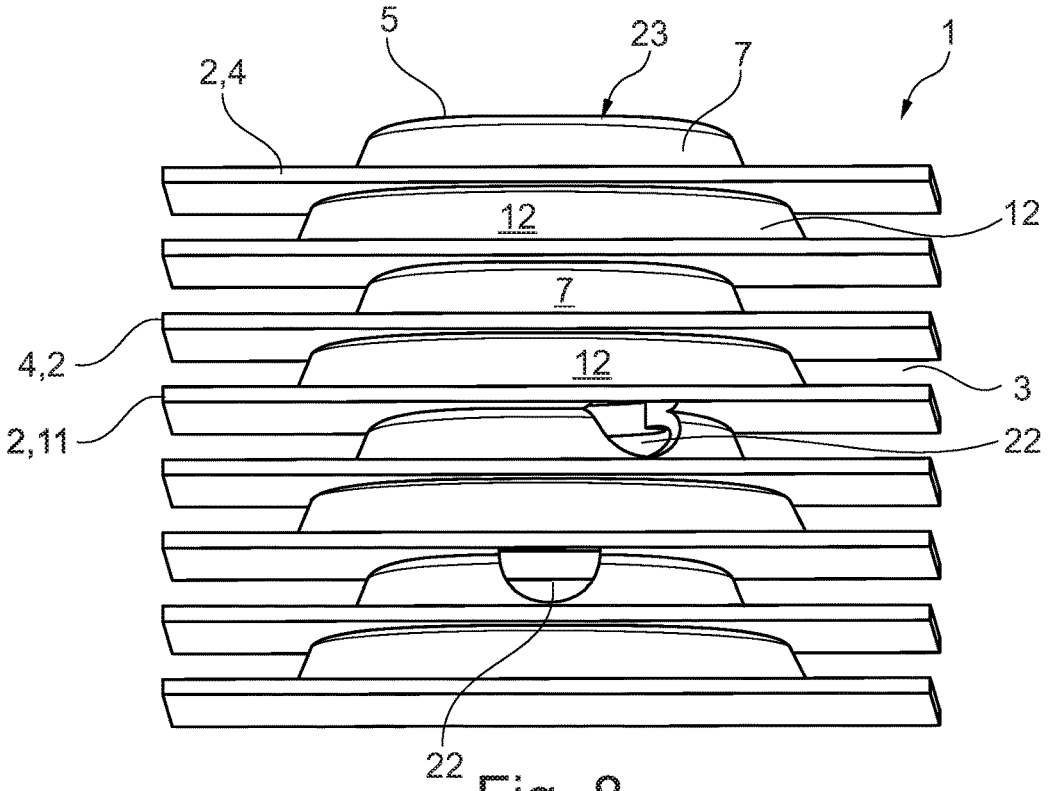
FIG. 8 shows a view of a stacked plate heat exchanger according to the invention with lateral outlets.
Figure 9:
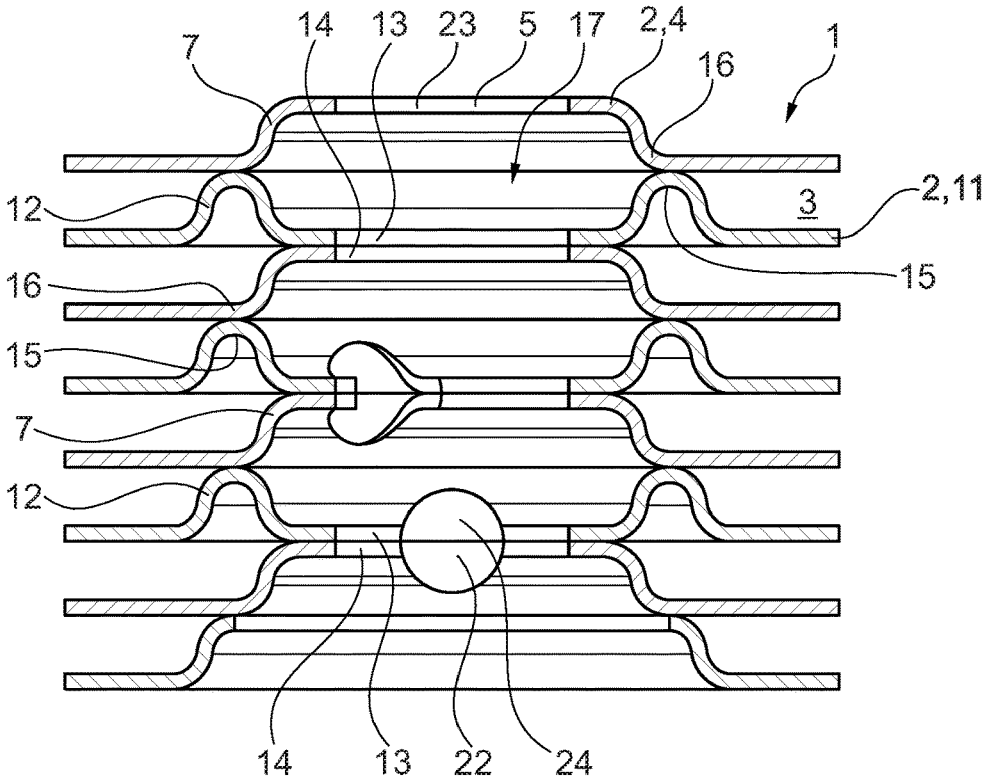
FIG. 9 shows a sectional representation through the stacked plate heat exchanger according to FIG. 8.
Figure 10:
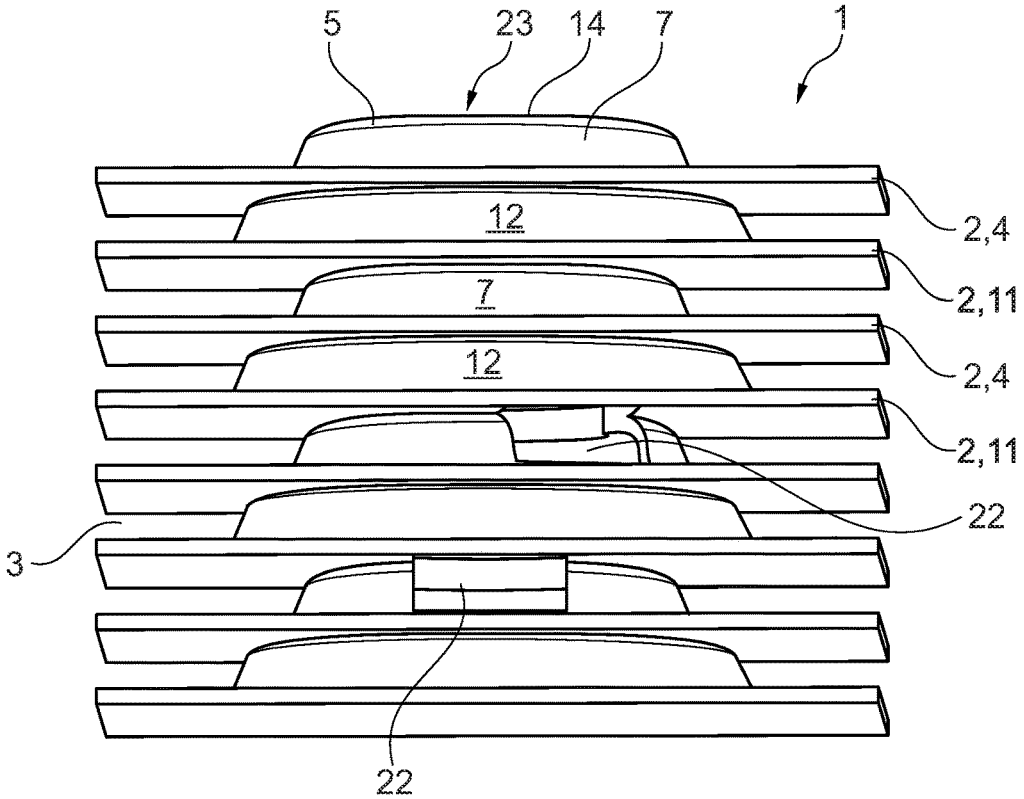
FIG. 10 shows a view of a stacked plate heat exchanger according to the invention with other lateral outlets.
Figure 11:
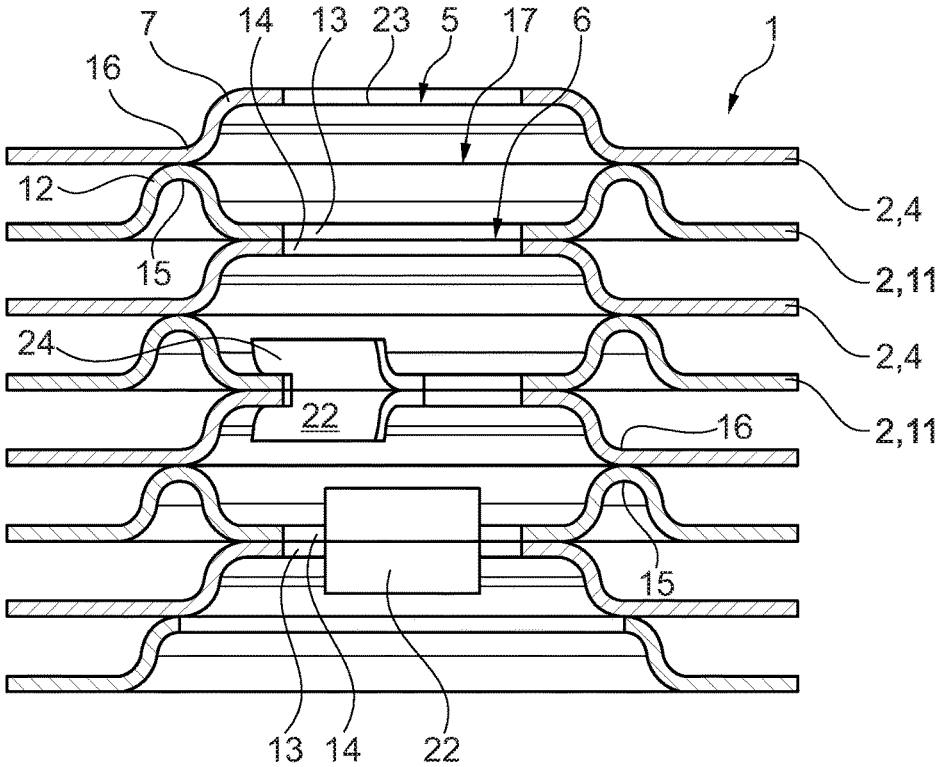
FIG. 11 shows a sectional representation through the stacked plate heat exchanger according to FIG. 10.

Now viewing the FIGS. 6 and 7, the integral formation of the immersion tube passage 7 exclusively by the first and second stacked plates 4, 11 can likewise be recognised by these. In FIG. 6, three second stacked plates 11 are again provided for example, as a result of which a first stacked plate 4 arranged below the same simultaneously forms the first partition plane 9.

According to FIG. 7, a medium is introduced into the stacked plate heat exchanger 1 as far as to the first partition plane 9 and there conducted further into the depth of the image plane by the immersion tube passage 17, which is formed by the first and second stacked plates 4, 11. At the opposite end, the media flow is diverted and again issues from the image plane in order to be subsequently discharged to the top right.

On the stacked plate heat exchanger 1 according to the invention as per the FIGS. 8 to 11, additional lateral outlets 22 are still provided, which can be produced in a simple manner. The outlets 22 of the FIGS. 8 and 9 have a rounded contour while the outlets 22 of the FIGS. 10 and 11 have an angular contour. By way of this, an integration of the vertical fluid flow path in the stacked plates 2 can be achieved. The lateral outlets 22 are preferably arranged in the lower region, i.e. distant from an inflow opening 23 in order to make possible a directed outflow which generates additional performance advantages.

The outlets 22 likewise form an integral part of the stacked plates 2 and can be produced by simple punching and forming of the free edge 13 of the annular bead 12 and of the free edge 14 of the dome 7. To this end, straps 24 are simply punched out of the edge 13, 14 and bent over in particular into the immersion tube passage 17.

With the first and second stacked plates 4, 11 according to the invention, the immersion tube passage 17 can be integrally formed, i.e. in particular without a separate element such as for example an immersion tube 8.

The invention claimed is:

1. A stacked plate heat exchanger, comprising:

a plurality of stacked plates stacked on top of one another and soldered to one another, between which a plurality of hollow spaces for two media are alternately defined;

at least two first stacked plates of the plurality of stacked plates respectively including at least one first passage opening and at least one second passage opening the at least one first passage opening surrounded by a dome projecting from a stacked plate plane;

at least one second stacked plate of the plurality of stacked plates including at least one first passage opening surrounded by a projecting dome and a second passage opening, the second passage opening of the at least one second stacked plate surrounded by an annular bead projecting from the stacked plate plane;

the at least one second stacked plate arranged between the at least two first stacked plates such that i) a free edge of the annular bead is connected to a free edge of the dome of a lower first stacked plate of the at least two first stacked plates arranged below the at least one second stacked plate and ii) an annular bead peak region of the at least one second stacked plate is connected to a foot of the dome of an upper first stacked plate of the at least two first stacked plates arranged above the at least one second stacked plate; and wherein an immersion tube passage is defined by the dome of the lower first stacked plate, the dome of the upper first stacked plate, and the annular bead connected to one another.

2. The stacked plate heat exchanger according to claim 1, wherein the at least one second passage opening of the at least two first stacked plates is a punched passage opening.

3. The stacked plate heat exchanger according to claim 1, wherein at least two first openings are disposed spaced apart from one another in a circumferential direction of and radially outside of the dome of each of the at least two first stacked plates.

4. The stacked plate heat exchanger according to claim 1, wherein the annular bead peak region is flat and includes a plurality of second openings.

5. The stacked plate heat exchanger according to claim 3, wherein the at least two first openings are one of a circular shape and an annular segment shape.

6. The stacked plate heat exchanger according to claim 4, wherein:

at least two first openings are disposed spaced apart from one another in a circumferential direction of and radially outside of the dome of each of the at least two first stacked plates; and the at least two first openings and the plurality of second openings are arranged aligned with one another and define a return passage which surrounds the immersion tube passage.

7. The stacked plate heat exchanger according to claim 1, further comprising a turbulence insert arranged in at least one of the plurality of hollow spaces.

8. The stacked plate heat exchanger according to claim 1, wherein the stacked plate heat exchanger is structured as one of a chiller, an oil cooler, and an indirect evaporator.

9. The stacked plate heat exchanger according to claim 1, further comprising a plurality of lateral outlets having a rounded contour and an angular contour.

10. The stacked plate heat exchanger according to claim 9, wherein at least one of:

the plurality of lateral outlets are arranged in a lower region distant from an inflow opening; and the plurality of lateral outlets are punched outlets defined by a plurality of straps, each of the plurality of straps defined by a portion of one of the free edge of the annular bead and the free edge of the dome of the lower first stacked plate.

11. The stacked plate heat exchanger according to claim 4, wherein the plurality of second openings are one of a circular shape and an annular segment shape.

12. A stacked plate heat exchanger, comprising:

a plurality of stacked plates stacked on top of one another in a stacking direction and soldered to one another, between which a plurality of hollow spaces for two media are alternately defined, the plurality of stacked plates including a plurality of first stacked plates and a plurality of second stacked plates;

the plurality of stacked plates respectively including at least one first passage opening surrounded by a dome projecting therefrom in the stacking direction and at least one second passage opening, the at least one second passage opening of the plurality of second stacked plates surrounded by an annular bead projecting therefrom in the stacking direction;

wherein each of the plurality of second stacked plates is arranged between two adjacent first stacked plates of the plurality of first stacked plates such that i) a free edge of the annular bead is coupled to a free edge of the dome of a lower first stacked plate of the two adjacent first stacked plates and ii) an annular bead peak region of the annular peak is coupled to a foot of the dome of an upper first stacked plate of the two adjacent first stacked plates; and wherein the dome of the lower first stacked plate, the dome of the upper first stacked plate, and the annular bead coupled to one another define an immersion tube passage.

13. The stacked plate heat exchanger according to claim 12, wherein each of the plurality of first stacked plates includes at least two first openings disposed radially outside of the dome and spaced apart from one another in a circumferential direction of the dome.

14. The stacked plate heat exchanger according to claim 12, wherein the annular bead peak region is flat and includes a plurality of second openings.

15. The stacked plate heat exchanger according to claim 13, wherein the at least two first openings are one of a circular shape and an annular segment shape.

16. The stacked plate heat exchanger according to claim 14, wherein:

each of the plurality of first stacked plates includes at least two first openings disposed spaced apart from one another in a circumferential direction of the dome and radially outside of the dome; and the at least two first openings and the plurality of second openings are arranged aligned with one another and define a return passage surrounding the immersion tube passage.

17. The stacked plate heat exchanger according to claim 12, further comprising a turbulence insert arranged in at least one of the plurality of hollow spaces.

18. The stacked plate heat exchanger according to claim 12, further comprising a plurality of lateral outlets each having one of a rounded contour and an angular contour.

19. The stacked plate heat exchanger according to claim 18, further comprising an inflow opening disposed spaced apart from a lower region, wherein the plurality of lateral outlets are arranged in the lower region.

20. The stacked plate heat exchanger according to claim 18, wherein the plurality of lateral outlets are punched outlets defined by a plurality of straps, each of the plurality of straps defined by a portion of one of the free edge of the annular bead and the free edge of the dome of the lower first stacked plate.

* * * * *